US007389810B2

(12) United States Patent
Harada

(10) Patent No.: US 7,389,810 B2
(45) Date of Patent: Jun. 24, 2008

(54) DISPLACEMENT PREVENTION DEVICE FOR THE SIDE PLATE OF A HEAT EXCHANGER

(75) Inventor: Masaki Harada, Kariya (JP)

(73) Assignee: Denso Corporation, Kariya (JP)

( * ) Notice: Subject to any disclaimer, the term of this patent is extended or adjusted under 35 U.S.C. 154(b) by 313 days.

(21) Appl. No.: 11/358,796

(22) Filed: Feb. 20, 2006

(65) Prior Publication Data

US 2006/0185824 A1 Aug. 24, 2006

(30) Foreign Application Priority Data

Feb. 22, 2005 (JP) ..... 2005-045499

(51) Int. Cl.
*F28D 1/00* (2006.01)
*F28F 7/00* (2006.01)

(52) U.S. Cl. ..... 165/149; 165/81

(58) Field of Classification Search ..... 165/81, 165/149, 152

See application file for complete search history.

(56) References Cited

U.S. PATENT DOCUMENTS 4,721,069 A * 1/1988 Kreider ..... 122/511
5,975,197 A * 11/1999 Kado ..... 165/149
6,328,098 B1 * 12/2001 Kodumudi et al. ..... 165/149
6,523,603 B2 * 2/2003 Uchikawa et al. ..... 165/81
6,736,193 B2 * 5/2004 Kodumudi et al. ..... 165/81

FOREIGN PATENT DOCUMENTS

EP 1 001 241 5/2000

* cited by examiner

*Primary Examiner*—Cheryl J. Tyler
*Assistant Examiner*—Brandon M Rosati
(74) *Attorney, Agent, or Firm*—Harness, Dickey & Pierce, PLC

(57) ABSTRACT

Side plates (4) each include a base portion (41), in contact with fins (11), and side wall portions (42) extending from the base portion (41) in the direction Y in which tubes (10) are stacked. The side wall portions (42) are formed with a bent deforming portion (421) to facilitate extension/shrinkage, of the side wall portions (42), in the longitudinal direction (X) of the tubes (10). The base portion (41) is formed with a pair of hooks (411) extending toward the surface of the bent deforming portion (421) in opposed relation to the base portion (41). In the case where the base portion (41) tends to be displaced, the hooks (411) come into contact with the bent deforming portion (421) to thereby suppress or prevent the displacement of the base portion (41).

2 Claims, 3 Drawing Sheets

DISPLACEMENT PREVENTION DEVICE FOR THE SIDE PLATE OF A HEAT EXCHANGER

BACKGROUND OF THE INVENTION

1. Field of the Invention

This invention relates to a heat exchanger for exchanging heat between fluids, which is effectively applicable to an intercooler for cooling the air (supercharged air) introduced into an internal combustion engine, for example, and is supercharged for combustion.

2. Description of the Related Art

The conventional heat exchanger, as shown in FIGS. 4, 5, is configured of a multiplicity of tubes 10 and a multiplicity of corrugated fins 11 stacked alternately with each other to make up a core unit 1. Also, tanks 2, 3 are arranged at the two ends in the longitudinal direction X of the tubes in the core unit 1, and side plates 4 are arranged at the two ends in the direction Y in which the tubes are stacked in the core unit 1.

This heat exchanger is assembled in such a manner that the component parts of the heat exchanger are assembled provisionally into a predetermined heat exchanger structure, after which the provisional assembly of the heat exchanger structure is fastened with wires from outside of the side plates 4 thereby to hold the state of the provisional assembly. Next, this provisional assembly is introduced into a brazing furnace and heated to the melting point of the brazing material thereby to braze the joints of the component parts of the assembly integrally with each other.

The side plates 4 have the function to hold the corrugated fins 11 located at the two ends in the stacking direction Y of the tubes and secure the brazed state between the corrugated fins 11 and the tubes 10.

In the case where this heat exchanger is used as an intercooler, and especially in a large diesel engine, a large temperature difference is generated between the tubes 10 and the side plates 4 due to the temperature of the supercharged air which has been increased to meet recently strengthened exhaust gas control requirements. The resulting difference of thermal expansion generates a large stress at the tube root (the joint between the tubes 10 and the tanks 2, 3) thereby often causing breakage of the tubes 10.

In view of this, the conventional heat exchanger has, in order to prevent the breakage of the tubes 10 due to the difference of thermal expansion, a slit 43 formed in the base portion 41 of each side plate 4 and a bent deforming portion 421 formed on each side wall portion 42 of the side plate 4 so that the side plates 4 are extended in accordance with the extension of the tubes 10 (for example, see the specification of European Patent Application Publication No. 1001241).

The conventional heat exchanger described above, however, has a gap between the base portion 41 and the bent deforming portion 421 in the direction Y in which the tubes are stacked. At the time of assembly before the integrating brazing process, therefore, the base portion 41 is liable to be displaced and the side plates 4 are easily twisted, thereby leading to the problem of buckling of the corrugated fins 11 and a dimensional error of the core unit assembly.

SUMMARY OF THE INVENTION

In view of the points described above, the object of this invention is to suppress buckling of the fins and a dimensional error of the core unit assembly.

In order to accomplish the above object, according to a first aspect of the present invention, there is provided a heat exchanger comprising: a core unit (1) including a multiplicity of tubes (10) and a multiplicity of fins (11) stacked alternately with each other; tanks (2, 3) arranged at the ends in the longitudinal direction (X) of the tubes (10) of the core unit (1) and communicating with the multiplicity of the tubes (10); and side plates (4) arranged at the ends in the stacking direction (Y) of the tubes (10) of the core unit (1) and having the ends thereof coupled to the tanks (2, 3); wherein the side plates (4) each include a base portion (41) in contact with the fins (11) and side wall portions (42) extending from the base portion (41) in the stacking direction (Y) of the tubes (10); wherein the side wall portions (42) are each formed with a bent deforming portion (421) to facilitate the extension and shrinkage of the side wall portions (42) in the longitudinal direction (X) of the tubes (10) by a bending deformation; wherein the base portion (41) is divided in the longitudinal direction (X) of the tubes (10) by a slit (43) formed at a position corresponding to the bent deforming portion (421); and wherein a pair of hooks (411) extending toward the end surface of the bent deforming portion (421) in opposed relation to the base portion (41) are formed at the slit (43) side ends of the divided parts, respectively, of the base portion (41).

According to one aspect of this invention, there is provided a heat exchanger in which in the case where the base portion tends to be displaced or the whole side plates tend to be twisted, a hook comes into contact with the deformed portion thereby to suppress or prevent the displacement of the base portion and the twisting of the side plates, thereby suppressing or preventing buckling of the fins and a dimensional error of the core unit assembly.

According to a second aspect of the present invention, the bent portion of the bent deforming portion (421) is gently curved.

In the prior art, the bent portion of the bent deforming portion has a steep angle and therefore the side plates are liable to be broken by stress concentration. According to a second aspect of the invention, the stress concentration can be prevented to thereby prevent the breakage of the side plates.

Incidentally, the reference numerals in parentheses, to denote the above means, are intended to show a relationship to the specific means which will be described later in an embodiment of the invention.

BRIEF DESCRIPTION OF THE DRAWINGS

The present invention may be more fully understood from the description of preferred embodiments of the invention set forth below, together with the accompanying drawings.

DESCRIPTION OF PREFERRED EMBODIMENTS

Figure 1:
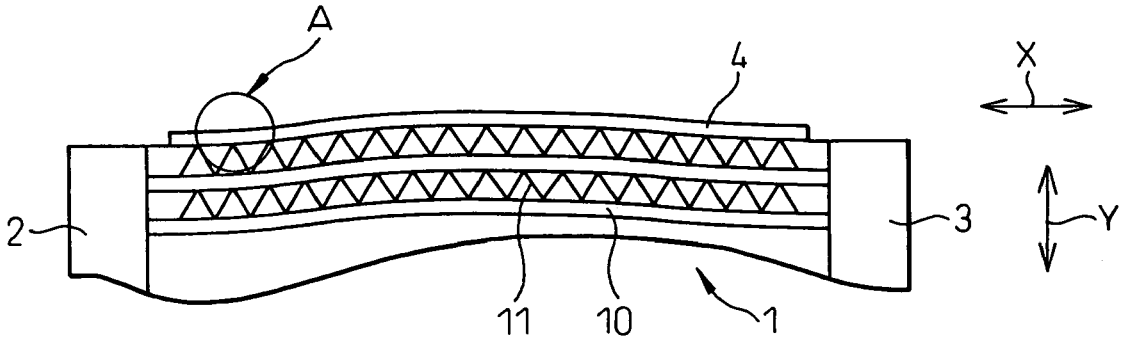
FIG. 1 is a front view of a heat exchanger according to an embodiment of the invention.

An embodiment of this invention is explained below. This embodiment represents an application of the heat exchanger according to the invention to the intercooler for cooling the supercharged air introduced into the internal combustion engine. FIG. 1 is a front view of the heat exchanger according to an embodiment, FIG. 2 an enlarged front view showing the portion A in FIG. 1, and FIG. 3 a perspective view of the side plate 4 in FIG. 1.

As shown in FIG. 1, the heat exchanger includes a parallelopipedal core unit 1 configured of a multiplicity of tubes 10 and a multiplicity of corrugated fins 11 stacked in alternate layers.

The tubes 10 are flat brass members having an internal path in which the supercharged air introduced into the internal combustion engine mounted on an automotive vehicle flows. The corrugated fins 11 are made of copper and are corrugated to promote the heat exchange between the supercharged air and the cool air.

Tanks 2, 3 communicating with the paths of the multiplicity of the tubes 10 are arranged at the ends in the longitudinal direction X of the tubes of the core unit 1. The tank 2 is made of brass and distributes the compressed supercharged air high in temperature to the multiplicity of the tubes 10. The other tank 3 also made of brass collectively recovers the supercharged air cooled by heat exchange with the cool air and supplies the resulting air to the internal combustion engine.

The side plates 4 for securing the brazing strength between the corrugated fins 11 and the tubes 10 and reinforcing the core unit 1 are arranged at the ends in the stacking direction Y of the tubes in the core unit 1. The side plates 4 are made of brass, and extending in parallel to the longitudinal direction X of the tubes, have the ends thereof connected to the tanks 2, 3.

Figure 2:
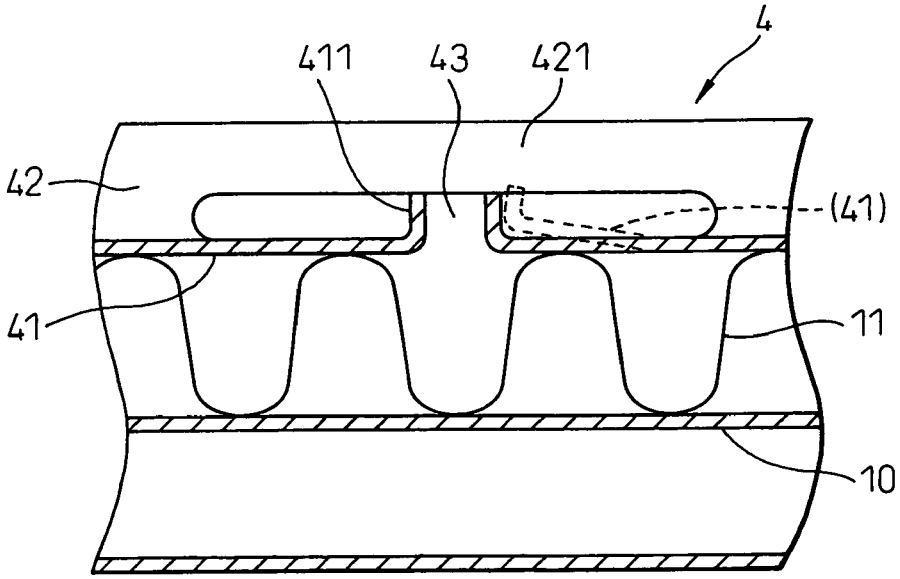
FIG. 2 is an enlarged front view of the portion A in FIG. 1.
Figure 3:
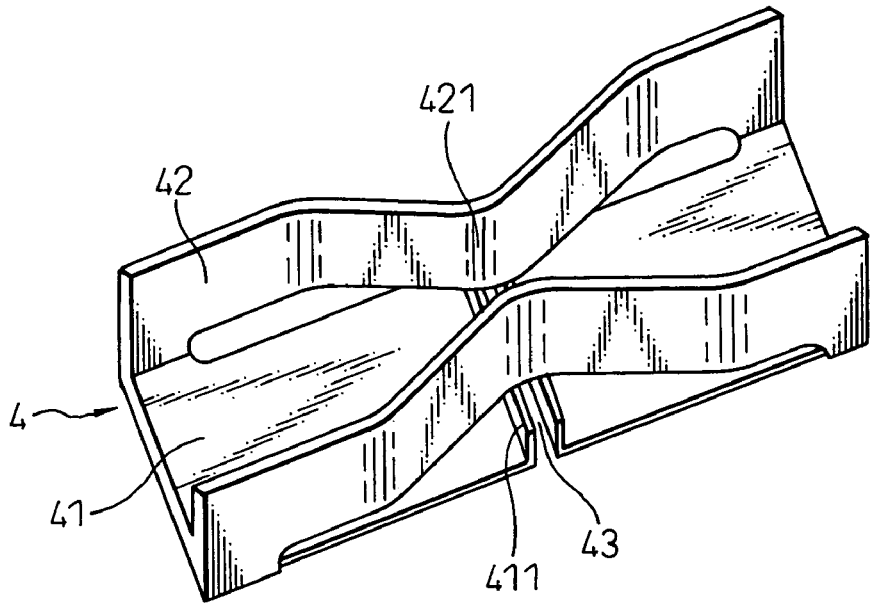
FIG. 3 is a perspective view showing the side plate 4 in FIG. 1.
Figure 4:
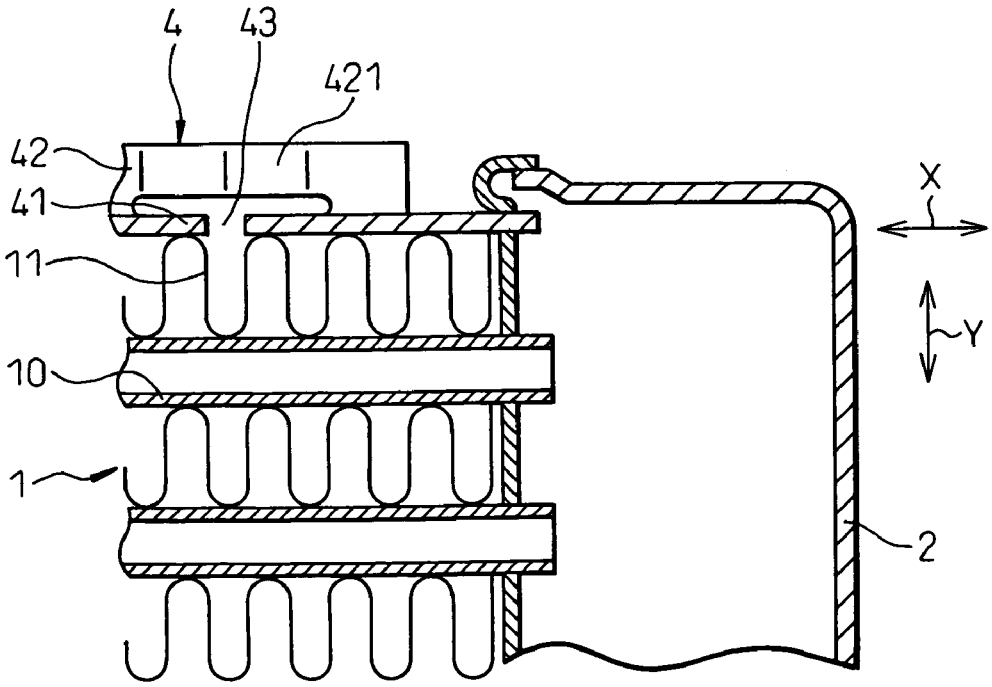
FIG. 4 is a sectional view showing the essential parts of the conventional heat exchanger.
Figure 5:
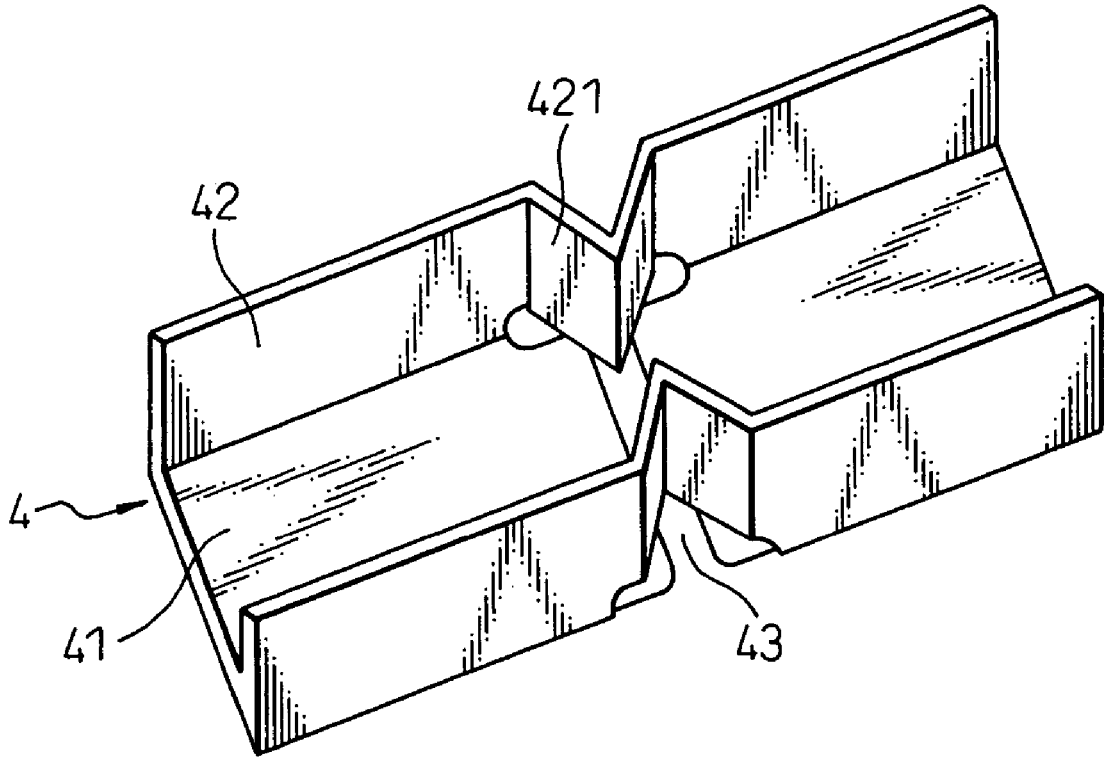
FIG. 5 is a perspective view of the side plate 4 shown in FIG. 4.

As shown in FIGS. 2, 3, the side plates 4 are press-formed into a channel-shaped cross section and include a base portion 41 in contact with and holding the corrugated fins 11 and side wall portions 42 located on the two sides of the base portion 41 and extending from the base portion 41 in the direction Y in which the tubes are stacked.

The side wall portions 42 are each formed with a bent deforming portion 421 adapted to be deformed by being bent to facilitate the extension of the side wall portions 42 along the longitudinal direction X of the tubes. The bent portion of the bent deforming portion 421 has a gentle curved surface. The difference in thermal expansion, which may occur between the tubes 10 and the side plates 4, is absorbed by the deformation of the deforming portion 421 thereby to suppress the thermal stress which otherwise might act on the tubes 10.

The base portion 41 is divided in the longitudinal direction X of the tubes 10 by a slit 43 formed at a position corresponding to the bent deforming portion 421, and is further formed with a pair of hooks 411 extending from the ends of the slit 43, respectively, toward and in opposed relation to the slit 43 side end surface of the bent deforming portion 421 of the base portion 41.

The bent deforming portion 421 and the hooks 411 are in proximity with, or in contact with, each other in a free state to thereby prevent the base portion 41 from being deformed as shown by dashed line in FIG. 2, i.e. in such a direction that the hooks 411 come away from the core unit 1.

The heat exchanger according to this embodiment having the above-mentioned configuration is brazed integrally in the manner described below. First, the tubes 10, the corrugated fins 11, the tanks 2, 3 and the side plates 4 making up the component parts of the heat exchanger are provisionally assembled into a predetermined structure as a heat exchanger, and then, this provisional heat exchanger assembly is fastened with a wire from the outside of the side plates 4 into the state of a provisional assembly structure. Next, this provisional assembly is introduced into a brazing furnace and heated to the melting point of the brazing material to thereby braze the joints of the parts of the assembly integrally with each other.

In the provisional assembly, before it is fastened with a wire, the intermediate portion in the longitudinal direction X of the tubes of the core unit 1 tends to expand outward in the stacking direction Y of the tubes during the brazing process, with the result that the base portion 41 of the side plates 4 tends to be displaced.

The tendency of the base portion 41 to be displaced causes the hooks 411 to come into contact with the bent deforming portion 421, thereby suppressing and preventing the base portion 41 being displaced and the side plates 4 being twisted. As a result, buckling of the corrugated fins 11 and a dimensional error of the core unit assembly can be suppressed or prevented.

In the case where a temperature difference occurs between the tubes 10 and the side plates 4, on the other hand, the bent deforming portion 421 is deformed and absorbs the difference of thermal expansion. Thus, the thermal stress acting on the tubes 10 is suppressed.

Further, in view of the fact that the bent portion of the bent deforming portion 421 is gently curved, the stress concentration, and hence the breakage of the side plates 4, are prevented at the time of deformation of the bent deformation portion 421. In this way, the maximum main stress on the bent portion of the bent deforming portion 421 can be reduced to about one third or one half of the value in the prior art.

Finally, other embodiments will be explained. Although the embodiments of the invention described above find application in the intercooler, this invention is also applicable to other heat exchangers.

Also, the parts including the tubes 10, the corrugated fins 11, the tanks 2, 3 and the side plates 4 may alternatively be formed of other metal materials such as iron or aluminum.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger comprising:

a core unit including a multiplicity of tubes and a multiplicity of fins stacked alternately with each other;

tanks arranged at the ends in the longitudinal direction of the tubes of the core unit and communicating with the multiplicity of the tubes; and side plates arranged at the ends in the stacking direction of the tubes of the core unit and having the ends thereof coupled to the tanks;

wherein the side plates each include a base portion in contact with the fins and side wall portions extending from the base portion in the stacking direction of the tubes;

wherein the side wall portions are each formed with a bent deforming portion to facilitate the extension and shrinkage of the side wall portions in the longitudinal direction of the tubes by the bending deformation;

wherein the base portion is divided in the longitudinal direction of the tubes by a slit formed at a position corresponding to the bent deforming portion; and wherein a pair of hooks extending toward of the bent deforming portion in opposed formed respectively at the slit side end of the base portion.

2. A heat exchanger according to claim 1, wherein the bent portion of the bent deforming portion is gently curved.

* * * * *